United States Patent [19]

Cotter

[11] 4,183,402

[45] Jan. 15, 1980

[54] HEAT EXCHANGER HEADERING ARRANGEMENT

[75] Inventor: Ray W. Cotter, Snyder, N.Y.

[73] Assignee: Union Carbide Corporation, New York, N.Y.

[21] Appl. No.: 903,147

[22] Filed: May 5, 1978

[51] Int. Cl.[2] ..... F28F 9/16

[52] U.S. Cl. ..... 165/175; 29/157.4

[58] Field of Search ..... 165/148, 149, 152, 153, 165/166, 172, 173, 175; 29/157.4

[56] References Cited

U.S. PATENT DOCUMENTS

| | | | |
|---|---|---|---|
| 2,462,421 | 2/1949 | Pitt | 165/166 |
| 2,926,003 | 2/1960 | Pulsifer | 165/170 |
| 2,985,433 | 5/1961 | Simpelaar | 165/166 |
| 3,265,126 | 8/1966 | Donaldson | 165/149 |
| 3,792,729 | 2/1974 | Perry | 165/175 |
| 3,845,814 | 11/1974 | Kun | 165/151 |
| 4,023,618 | 5/1977 | Kun et al. | 165/175 |

FOREIGN PATENT DOCUMENTS

| | | | |
|---|---|---|---|
| 1133291 | 11/1968 | United Kingdom | 165/166 |

*Primary Examiner*—Sheldon Richter
*Attorney, Agent, or Firm*—Steven J. Hultquist

[57] ABSTRACT

A heat exchanger assembly comprising a stacked array of heat exchange channel elements, having first fluid entrance and exit faces at opposite ends of the array. The improved headering arrangement includes sealing members each having a bearing surface with a generally corrugated contour which is bonded to the correspondingly contoured edge walls of the channel elements along a side of the stacked array and header tank means joined to the sealing members so as to leak-tightly enclose the associated face of the stacked array of heat exchange channel elements.

14 Claims, 11 Drawing Figures

FIG. 1
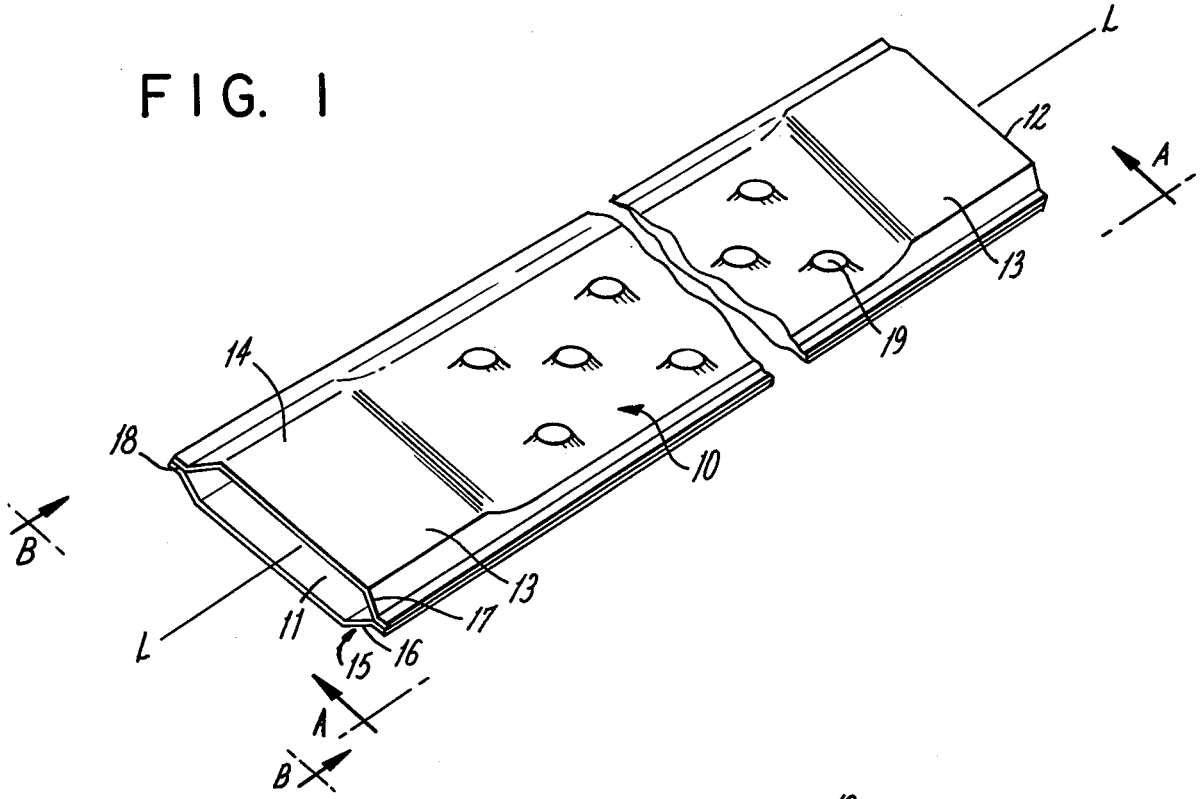
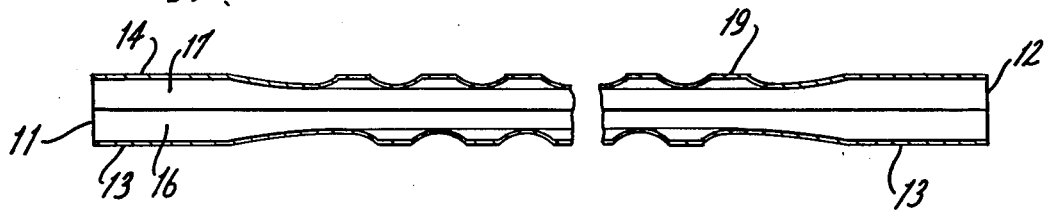
FIG. 2
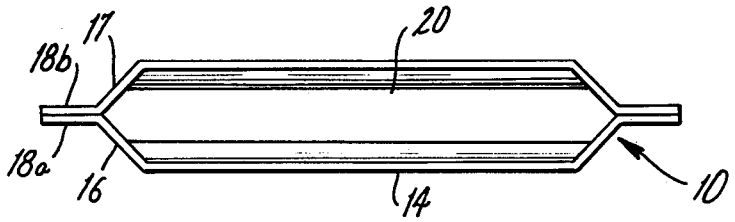
FIG. 3

HEAT EXCHANGER HEADERING ARRANGEMENT

BACKGROUND OF THE INVENTION

1. Field of the Invention

This invention relates to an improved headering means for a heat exchanger comprising a stacked array of heat exchange channel elements.

2. Description of the Prior Art

In the field of heat exchange applications requiring pressure-bearing walls as the primary heat exchanger surface, considerable effort has been expended to develop light weight, inexpensive heat exchange elements. In recent years a number of compact heat exchanger designs have been developed which utilize comparatively thin-walled heat transfer chanel elements, e.g., 8–12 mils in thickness, of light weight materials such as aluminum. Such types of heat exchangers have particular utility in automobile radiator and heater applications, where size and weight are primary considerations.

An illustrative heat exchanger construction for the foregoing applications is disclosed in U.S. Pat. No. 3,757,856 issued Sept. 11, 1973 to L. C. Kun, wherein each channel element of the heat exchanger is provided with an isostress contoured heat exchange surface comprising a multiplicity of uniformly disposed outwardly extending projections formed from a portion of each wall surface. These projections have load-bearing segments at their extremities whereby the facing walls of adjacent channel elements are mated in supportive relationship with each other. Upon being subjected to a differential pressure across the channel wall, a substantially uniform fiber stress distribution is obtained in the isostress contoured surface. This uniform stress distribution substantially eliminates stress concentration points in the walls of the channel elements thereby permitting the walls to be fabricated from very thin sheets of thermally conductive material.

In such heat exchangers constructed from thin-walled channel elements, wherein the channel elements are stacked in an array to form the heat exchanger core, the provision of low-cost, easily fabricated header means which maintain an efficient fluid-tight seal with the channel elements in the stacked array encompasses specific problems not encountered in headering arrangements in heavier walled systems. With channel elements having pressure withholding walls of lower thickness, there is a lower resistance to heat transfer associated with the walls, in other words, a higher rate of heat transfer per unit weight of wall material, which permits the thin-walled channel elements to be closely spaced together to form a highly compact stacked array. Associated with the degree of compactness are correspondingly small dimensions for the channel elements.

As an example of the above-described structural characteristics of thin-walled channel element heat exchangers, in a heat exchanger constructed with channel elements of the type as disclosed in the aforementioned Kun U.S. Pat. No. 3,757,856 and suitable for use as an automobile radiator, the stacked array may be formed of 150 channel elements each 30 inches long with a cross-section characterized by a 1 inch major axis, a minor axis of 0.12 inch and a wall thickness of 0.008 inch. In such array, the spacing between facing walls of adjacent channel elements may be on the order of 0.120 inch. Thus, the provision of inlet header means joined in flow communication with the channel elements at one end of the array and outlet header means joined in flow communication with the channel elements at the opposite end of the array requires the fluid-tight sealing of numerous header-array joints of exceedingly small dimensions. In addition, the thinness of the channel element walls render them easily susceptible to bending and deformation in the heat exchanger fabrication process.

As a consequence of the foregoing characteristics of thin wall channel element heat exchangers, it is both difficult and expensive to employ conventional headering arrangements such as are used in the fabrication of large-scale heat exchangers. For example, in the construction of commercial tube-and-shell heat exchangers and automobile radiators, it is common practice to employ a tube sheet headering arrangement. In such systems, the tubes in the heat exchanger core assembly are characteristically forced through correspondingly sized openings in a sheet member and the latter is then joined to suitable tank or shell means to form a header chamber communicating with the tubes of the core assembly for introduction or withdrawal of fluid being passed through the tube members. Alternatively, the tube members may be smaller in size than the openings in the tube sheet and after being passed through the openings the tubes are expanded as by swaging or other means to form a fluidtight seal between the tubes and surrounding sheet. These approaches are not practical in application to thin wall channel element heat exchangers, due to their aforementioned susceptibility to bending and deformation during the associated fabrication steps and the need for extremely narrow dimensional tolerances for both the channel elements and the closely spaced tube sheet openings.

As a result of the inapplicability of conventional large-scale heat exchanger headering designs, a variety of header configurations have been proposed to accommodate the specific structural features of thin wall channel element systems. In the aforementioned Kun U.S. Pat. No. 3,757,856, a tank header arrangement is disclosed wherein comb-shaped members are inserted into the end sections of the channel element stacked array from opposite sides such that the corresponding teeth of the respective combs sealingly overlap one another and serve as spacers between adjacent channel elements. A tank is then suitably attached to the periphery of the comb members at each end of the array to form the respective fluid introduction and exit means. This design, while overcoming the inherent deficiencies of the conventional tube sheet headering arrangement, is nonetheless associated with numerous closely spaced comb member-channel element joints which must be leak-tightly sealed so that in the operational mode a fluid fed through the channel elements will not leak into the space between adjacent elements. Accordingly, each of these individual joints must be bonded as by adhesive to insure positive sealing, a step which is tedious, time-consuming and costly.

Another type of headering arrangement which has been proposed for thin-walled channel element stacked array heat exchangers incorporates channel elements having closed ends and flat side walls at the end sections with openings in the side walls for ingress and egress of the fluid being flowed through the channel element. In one such arrangement the header means include manifold tubes passing through the openings in the channel elements, the manifold tubes having flow openings whereby fluid communication is established between the tubes and the channel elements. This arrangement requires fluid-tight sealing of the numerous small joints between the tube and the associated flat side wall portions of the stacked channel elements, which is difficult to achieve economically. Another variant configuration under this arrangement involves bonding of the flat side wall portions surrounding the wall openings on adjacent channel elements to each other in wall to wall contacting relationship. This design is somewhat more advantageous in that the joint surfaces have a relatively large area for bonding as compared to the aforedescribed systems so that it is easier to fabricate. Nonethelss, a multiplicity of bonding joints, associated with an exceedingly large aggregate joint length, are again employed each of which must be positively sealed to insure operability of the heat exchanger assembly.

Accordingly, it is an object of the present invention to provide an improved headering arrangement for heat exchangers of the type employing a stacked array of thin-walled heat exchange channel elements.

It is further object of the invention to provide a heat exchanger assembly of the above type which is easily fabricated and incorporates joints having a relatively low aggregate joint length which must be leak-tightly sealed.

Other objects and advantages of the invention will be apparent from the ensuing disclosure and appended claims.

SUMMARY OF THE INVENTION

This invention relates to an improved headering arrangement for a heat exchanger comprising a stacked array of channel elements.

Briefly, the invention relates to a heat exchanger assembly including a stacked array of heat exchange channel elements, wherein each channel element has a longitudinal axis and is bounded by thermally conductive pressure withholding walls, with a first fluid entrance opening at one end, a first fluid exit opening at the opposite end, and end sections each having a cross-section bounded by flat side walls and by edge walls comprising edge walls portions extending outwardly from the side walls and convergently with respect to each other. The outermost ends of the edge wall portions are contiguous and coextensive with respect to one another to form a leak-tight edge wall and wherein adjacent channel element in the array are stacked with their end section side walls in wall to wall contacting relationship and their end section edge walls in alignment to form a first fluid entrance face at one end of the array and a first fluid exit face at the opposite end of the array. Each aforementioned face has a perimeter defined by edge wall ends of the stacked channel elements and outermost side wall ends of the outermost channel elements in the array. The pressure withholding walls of adjacent channel elements in the interior of the array are disposed in spaced relationship with respect to each other for flow of a second fluid through the array in the space between the channels in heat exchange with the first fluid. An inlet header is joined in flow communication with the first fluid entrance face for introduction of first fluid to the channel elements, and an outlet header is joined in flow communication with the first fluid exit face for withdrawal of first fluid from the channel elements.

In accordance with the invention, each aforementioned header comprises the improvement of sealing members extending along the end section edge walls of the channel elements at each side of the stacked array, each having a bearing surface with a generally corrugated contour of grooves and interposed ridges, with each of the grooves shaped so as to surround and abut the edge wall of a single channel element of the array with the interposed ridges extending inwardly and abutting the facing edge wall portions of adjacent channel elements. The bearing surface of each sealing member is bonded to the abutted channel element edge walls associated therewith, and has a length as measured parallel to the channel element longitudinal axes of at least 0.2 inch which is substantially greater than the thickness of the sealing member as measured perpendicular to the channel element longitudinal axes at a lower extremity of the grooves in the bearing surface thereof. Header tank means are joined to the sealing members so as to leak-tightly enclose the associated face of the stacked array of heat exchange channel elements.

The specific improvement features of the heat exchanger assembly of this invention provide a significant advantage over heat exchangers of the prior art which require positive leak-tight sealing of numerous discrete and small-sized heat exchanger core-header joints. Inasmuch as the inlet and exit faces of the heat exchanger assembly in the present invention each feature a single, extended perimeter joint surface, the fabrication of the assembly is comparatively simpler and less time-consuming and costly, relative to the channel element heat exchanger configurations of the prior art.

BRIEF DESCRIPTION OF THE DRAWINGS

FIG. 1 is an isometric view of a heat exchange channel element such as may be suitably employed in the heat exchanger assembly of the present invention.

FIG. 2 is an elevational view of the heat exchange channel element of FIG. 1, taken along line A—A of FIG. 1.

FIG. 3 is an elevational view of the heat exchange channel element of FIG. 1, taken along line B—B of FIG. 1.

DESCRIPTION OF THE PREFERRED EMBODIMENTS

Figure 4:
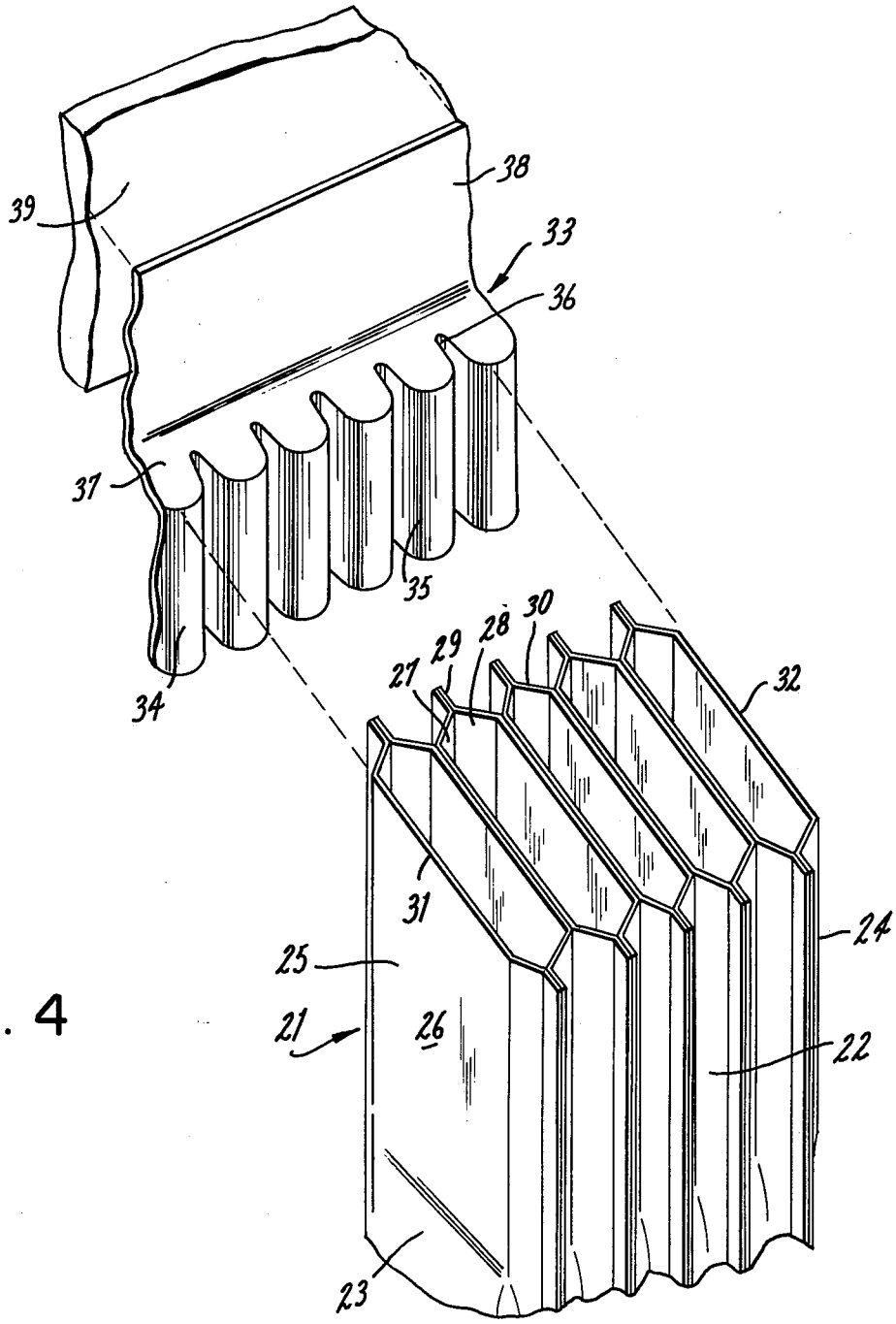
FIG. 4 is an exploded isometric view of a portion of a heat exchanger assembly according to one embodiment of the invention.

Referring now to the drawings, FIG. 1 is an isometric view of a heat exchange channel element such as may be usefully employed in a heat exchanger assembly constructed in accordance with the present invention. The heat exchange channel element 10 has a longitudinal axis L—L and is bounded by thermally conductive pressure withholding walls, with a first fluid entrance opening 11 at one end and a first fluid exit opening 12 at the opposite end. The channel element features end sections 13 each having a cross-section bounded by flat side walls 14 and by edge walls 15. The edge wall 15 comprises edge wall portions 16 and 17 extending outwardly from the side walls 13 and convergently with respect to each other. The outermost ends 18 of the edge wall portions 16 and 17 are contiguous and coextensive with respect to one another to form a leak-tight edge wall.

The pressure withholding walls of the channel element in the interior of the element have a multiplicity of uniformly disposed outwardly extending projections 19 formed from a portion of the wall surface. The projections have load-bearing segments at their extremities whereby facing walls of adjacent channel elements in a stacked array are mated in supportive relationship with each other. The channel element surface projections are preferably of a type as disclosed and claimed in U.S. Pat. No. 3,757,856, incorporated herein to the extent pertinent, wherein an isostress wall surface is provided between and surrounding the load-bearing segments which is continuously curved and devoid of local mechanical loading. Preferably, the thermally conductive pressure withholding walls of the heat exchange channel element are formed of aluminum and are preferably of between 0.003 and 0.020 inch thickness.

FIG. 2 is an elevational view of the heat exchange channel element of FIG. 1, taken along line A—A. As described, the channel element features an entrance opening 11 at one end and an exit opening 12 at the opposite end. The end sections 13 of the channel each have a cross section bounded by flat side walls 14 and edge walls 15 comprising edge wall portions 16 and 17. The channel element is constructed with a multiplicity of uniformly disposed outwardly extending projections 19 formed from a portion of pressure withholding wall surface in the interior of the channel element.

FIG. 3 is an elevational view of the heat exchannel element of FIG. 1, taken along line B—B. As shown, the edge wall portion 16 and 17 of the edge wall extend outwardly from the side walls 14 and convergently with respect to each other. The outermost ends 18*a* and 18*b* of the edge wall portion 16 and 17, respectively, are contiguous and coextensive with respect to one another to form a leak-tight edge wall. The end section of the channel element has a greater cross-section than the interior portion of the channel element, with the internal first fluid flow passage 20 in the interior portion of the channel element being in fluid flow communication with the end section of the channel element.

FIG. 4 is an exploded isometric view of a portion of a heat exchanger assembly constructed in accordance with the invention, utilizing channel elements of the general type as shown in FIGS. 1–3. A stacked array 21 of heat exchange channel elements 22 is provided, each channel element with end sections 25 bounded by flat side walls 26 and by edge walls comprising edge wall portions 27 and 28 extending outwardly from the side walls and convergently with respect to each other, with the outermost ends 29 of the edge wall portions being contiguous and coextensive with respect to one another to form a leak-tight edge wall. Adjacent channel elements in the array 21 are stacked with their end section side walls in wall to wall contacting relationship and with end section edge walls in alignment to form a first fluid entrance face at one end of the array. In like manner, a first fluid exit face (not shown) is formed at the opposite end of the array. Each of these faces has a perimeter defined by edge wall ends 30 of the stacked channel elements and outermost side wall ends 31, 32 of the outermost channel elements 23, 24 in the array. The pressure withholding walls of adjacent channel elements in the interior of the array are disposed in spaced relationship with respect to each other for flow of a second fluid through the array in the space between the channel elements in heat exchange with the first fluid. An inlet header is joined in flow communication with the first fluid entrance face for introduction of first fluid to the channel elements, and an outlet header is joined in flow communication with the first fluid exit face for withdrawal of first fluid from the channel elements.

FIG. 4 shows a portion of an inlet header constructed in accordance with the present invention. A similarly constructed outlet header (not shown) is disposed at the opposite end of the stacked array. The inlet header comprises a sealing member 33 extending along the end section edge walls of the channel elements at one side of the stacked array. Although not shown for purposes of clarity, a similarly constructed sealing member extends along the end section edge walls of the channel elements at the other side of the stacked array.

The sealing member 33 has a bearing surface 34 with a generally corrugated contour of grooves 36 and interposed ridges 35, with each of the grooves shaped so as to surround and abut the edge wall of a single channel element of the array with the interposed ridges extending inwardly and abutting the facing edge wall portions of adjacent channel elements. The bearing surface of the sealing member is bonded to the abutted channel element edge walls associated therewith, and has a length as measured parallel to the channel element longitudinal axes of at least 0.2 inch, for reasons which will be discussed more fully hereinafter. The length of the bearing surface is substantially greater than the thickenss of the sealing member as measured perpendicular to the channel element longitudinal axes at a lower extremity of the grooves in the bearing surface thereof, for reasons which will also be discussed more fully hereinafter.

As shown, the longitudinally extending bearing surface 34 of the sealing member 33 terminates at its upper end at a transversely extending intermediate portion 37 of the sealing member. The intermediate portion 37 is in turn integrally joined to a longitudinally extending flange portion 38 of the sealing member, to which header tank means 39 are joined. The sealing member 33, comprising bearing surface 34, transversely extending intermediate portion 37 and longitudinally extending flange portion 38, is of unitary construction and may suitably be fabricated as for example by stamping from a single sheet of material such as aluminum. The sealing member is of uniform thickness, which thickness is preferably less than 0.1 inch to minimize size and weight of the overall heat exchanger assembly and to preclude the sealing member from constituting a thermal mass of such dimension as to deleteriously interfere with the heat transfer performance of the heat exchanger assembly.

As described above, the bearing surface of the sealing member in the practice of the present invention is bonded to the abutted channel element edge walls associated therewith, and has a length as measured parallel to the channel element longitudinal axes of at least 0.2 inch. The length of the bearing surface must be at least 0.2 inch in order to provide sufficient areal extent for bonding to the stacked array of channel elements and thereby provide a structurally rigid assembly constituted by the stacked array of heat exchange channel elements and the header. In accordance with the invention, the length of the bearing surface is substantially greater than the thickness of the sealing member as measured perpendicular to the channel element longitudinal axes at a lower extremity of the grooves in the bearing surface thereof. The purpose of such constraint is to simultaneously provide for sufficient bonding area between the sealing member and the stacked array for structural rigidity and the provision of a suitably strong bond be- the sealing member and the stacked array, while insuring that the thickness of the sealing member is sufficiently proportioned for mechanical strength thereof without constituting a thermal mass of such dimension as to detrimentally interfere with the heat transfer characteristics of the heat exchanger assembly. Under such considerations, the length of the bearing surface is preferably at least twice the thickness of the sealing member.

Figure 5:
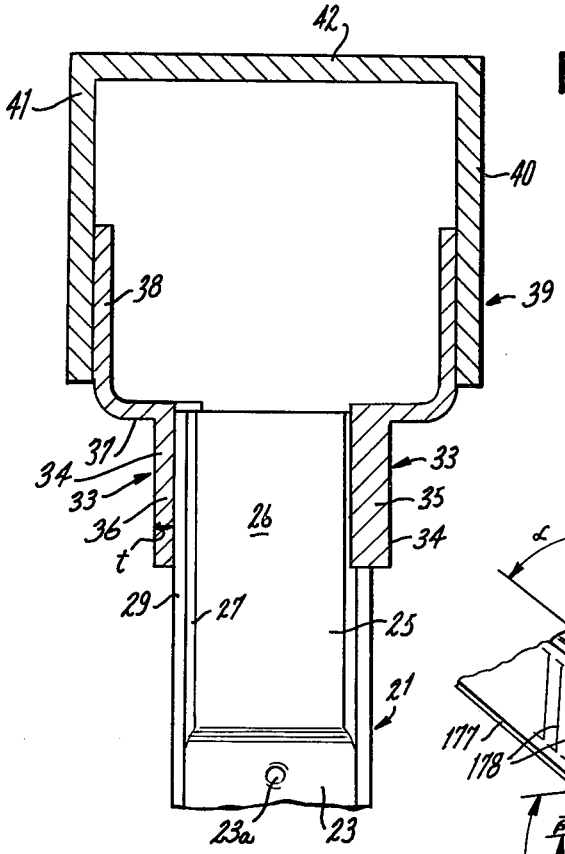
FIG. 5 is a sectional, elevational view of a heat exchanger assembly, corresponding to the embodiment of the invention shown in FIG. 4.

FIG. 5 is a sectional view of a portion of a heat exchanger assembly according to the invention, utilizing a headering arrangement of the type as shown and described in connection with FIG. 4. The heat exchanger core comprises a stacked array 21 of heat exchange channel elements 23 assembled in the manner as shown and described in connection with FIG. 4. Each of the channel elements is constructed with a multiplicity of uniformly disposed outwardly extending projections 23*a* formed from a portion of pressure withholding wall surface of the channel element. These projections have loadbearing segments at their extremities whereby the facing walls of adjacent channel elements are mated in supportive relationship with each other in the array. The channel elements each feature an end section 25 bounded by flat side walls 26 and by edge walls comprising edge wall portions 27 extending outwardly from the side walls and convergently with respect to each other, with the outermost ends 29 of the edge wall portions being contiguous and coextensive with respect to one another to form a leak-tight edge wall.

The header of the FIG. 5 assembly comprises sealing members 33 extending along the end section edge walls of the channel elements at each side of the stacked array. The sealing members have a bearing surface 34 with a generally corrugated contour of grooves 36 and interposed ridges 35, with each of the grooves 36 shaped so as to surround and abut the edge wall of a single channel element of the array with the interposed ridges 35 extending inwardly and abutting the facing edge wall portions of adjacent channel elements. Each of the sealing members has a longitudinally extending bearing surface portion 34, a transversely outwardly extending intermediate portion 37 and a longitudinally extending flange portion 38 to which the header tank means 39 are joined. The header tank means 39 are joined to the sealing members 33 so as to leak-tightly enclose the associated face of the stacked array of heat exchange channel elements. The header tank means 39 comprises a header tank member with an enclosure end wall 42 and side wall portions 40 and 41. The header tank member may suitably be formed from a lightweight metal such as aluminum, as by extrusion or other suitable fabrication technique. In practice, the lower segments of the enclosure side walls 40 and 41 may be adhesively bonded to the longitudinally extending flange portions 38 of the respective sealing members 33. In like manner, the bearing surface of each sealing member may be adhesively bonded to the abutted channel element edge walls associated therewith, as for example by an epoxy adhesive. Where adhesive is employed to bond the bearing surface of each sealing member to the abutted channel element edge walls associated therewith, the adhesive bond between the bearing surface and the abutted channel element edge walls is preferably less than 0.02 inch in thickness, in order to minimize thermal stresses on the adhesive joint in operation. As used herein, the terms "abut" and "abutting" are broadly intended to mean either directly contiguous or else contiguous through an interposed bonding medium.

Figure 6:
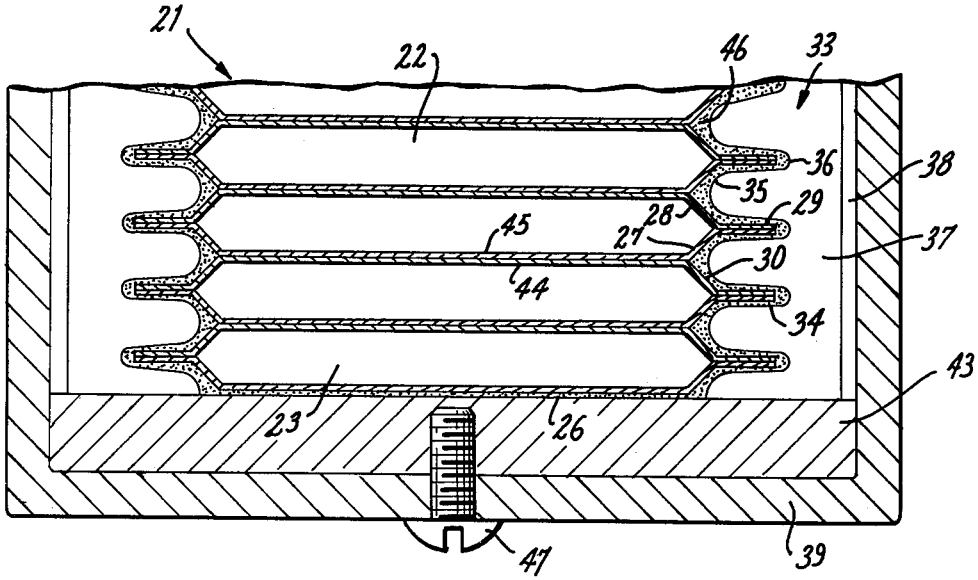
FIG. 6 is a sectional pla view of a heat exchanger assembly, corresponding to the embodiment of the invention shown in FIG. 4.

FIG. 6 is a sectional plan view of a portion of a heat exchanger assembly of a type as shown in FIGS. 4 and 5. Common elements in FIG. 6 are numbered correspondingly with respect to FIGS. 4 and 5. The heat exchanger assembly shown in FIG. 6 comprises a stacked array 21 of heat exchanger channel elements 22. Adjacent channel elements in the array are stacked with their end section side walls 44, 45 in wall to wall contacting relationship and with their end section edge walls in alignment to form a first fluid face at an end of the array for introduction or removal of fluid from the constituent channel elements thereof. Each channel element has edge walls comprising edge wall portions 27, 28 extending outwardly from the side walls 44, 45 and convergently with respect to each other, with the outermost ends 29 of the edge wall portions being contiguous and coextensive with respect to one another to form a leak-tight edge wall. The illustrated face of the stacked array has a perimeter defined by edge wall ends of the stacked channel elements and outermost side wall ends 26 of the outermost channel element 23 in the array. In the array, the channel element end section flat side walls are disposed in wall to wall contacting relationship and are adhesively bonded to each other. Sealing members 33 extend along the end section edge walls of the channel elements at each side of the stacked array. Each sealing member has a bearing surface 34 with a generally corrugated contour of grooves 36 and interposed ridges 35, with each of the grooves shaped so as to surround and abut the edge wall of a single channel element of the array with the interposed ridges extending inwardly and abutting the facing edge wall portions of adjacent channel elements. The bearing surface of each sealing member is bonded, as for example by an epoxy adhesive 46, to the abutted channel element edge walls 30 associated therewith. The sealing member 33 is constructed in the manner as shown and described in connection with FIG. 4 and has a longitudinally extending bearing surface portion 34, a transversely extending intermediate portion 37 and a longitudinally extending flange portion 38. Header tank means 39 is joined to the sealing member flange portion 38 so as to leak-tightly enclose the associated face of the stacked array of heat exchange channel elements. The outermost channel element 23 in the stacked array is adhesively bonded to and abuts structural support member 43. The purpose of structural support member 43 is to balance the outwardly directed pressure forces exerted by the stacked array of channel elements during operation. In order to carry out this function, the structural support member 43 is joined to the header tank means 39 by screw 47.

Figure 7:
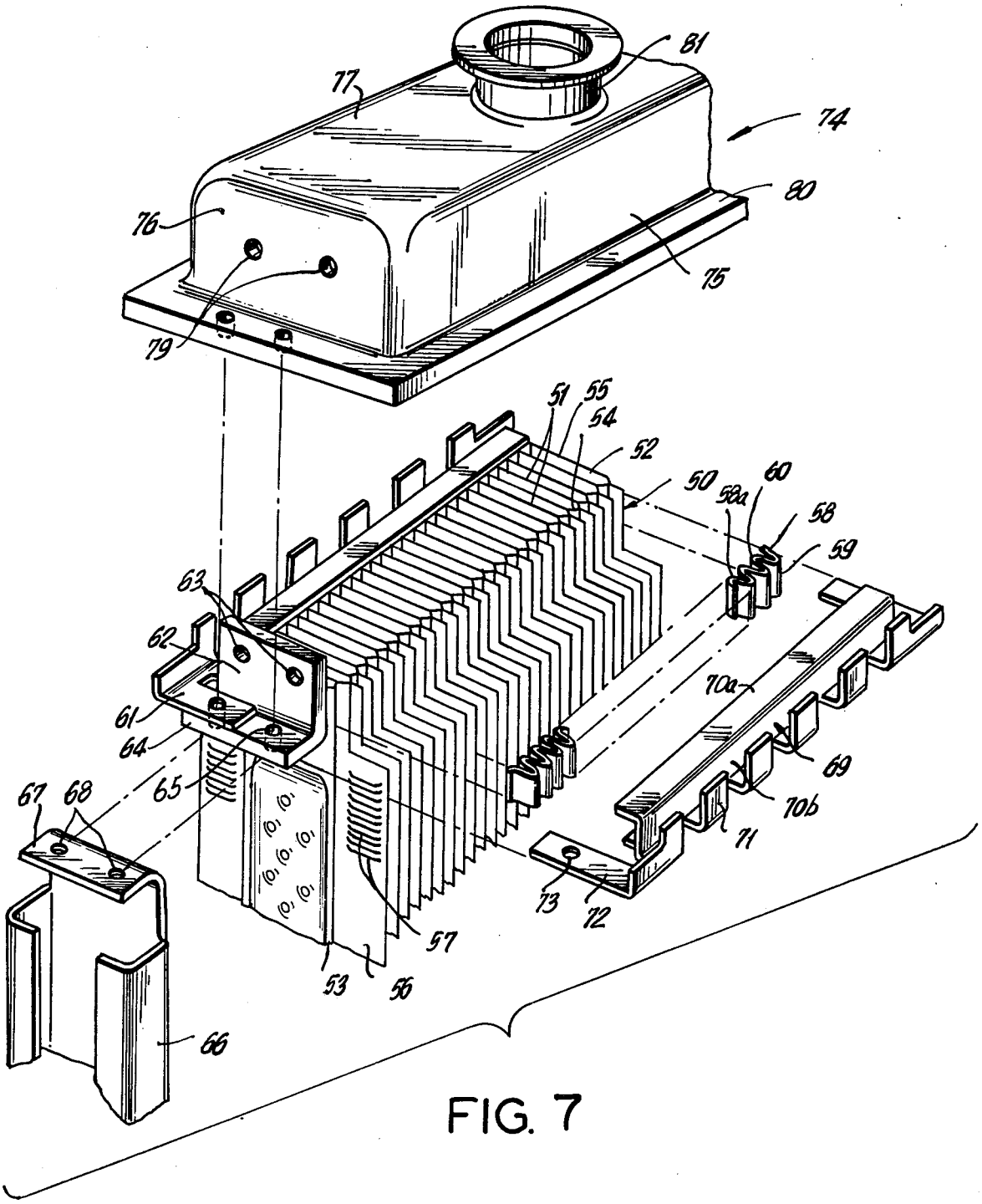
FIG. 7 is an exploded isometric view of a heat exchanger assembly according to another embodiment of the invention.

FIG. 7 is an exploded isometric view of a heat exchanger assembly according to another embodiment of the invention. As shown, the heat exchanger assembly comprises a stacked array 50 of heat exchange channel elements 51. Each channel element has a longitudinal axis and is bounded by thermally conductive pressure withholding walls, with a first fluid entrance opening at one end, a first fluid exit opening at the opposite end, and end sections each having a cross-section bounded by flat side walls and by edge walls comprising edge wall portions extending outwardly from the side walls and convergently with respect to each other, with the outermost ends of the edge wall portions being contiguous and coextensive with respect to one another to form a leak-tight edge wall. Thus, the channel elements may each be fabricated in a manner similar to that shown and described in connection with FIGS. 1–3 herein. Adjacent channel elements in the array are stacked with their end section side walls in wall to wall contacting relationship and their end section edge walls in alignment to form a first fluid entrance face at one end of the array and a first fluid exit face at the opposite end of the array. Each face has a perimeter defined by edge wall ends 54 of the stacked channel elements and outermost side wall ends 55 of the outermost channel elements 52, 53 in the array. The pressure withholding walls of adjacent channel elements in the interior of the array are disposed in spaced relationship with respect to each other for flow of a second fluid through the array in the space between the channel elements in heat exchange with the first fluid. The heat exchanger assembly shown in FIG. 7 is of the cross-flow type and is constructed and arranged for flow of the second fluid through the array in a direction normal to the longitudinal axis of the channel elements. Inlet header means are joined in flow communication with the first fluid entrance face for introduction of first fluid to the channel elements, and an outlet header is joined in flow communication with the first fluid exit face for withdrawal of the first fluid from the channel elements. The channel elements 53 in the FIG. 7 heat exchanger assembly differ from those shown in FIGS. 1–3 herein, in that they are provided with secondary surface fins 56 having louvered surface distortions 57 thereon.

The headering arrangement in the FIG. 7 assembly includes sealing members 58 extending along the end section edge walls of the channel elements at each side of the stacked array. Each sealing member has a bearing surface with a generally corrugated contour of grooves 59 and interposed ridges 60, with each of the grooves shaped so as to surround and abut the edge wall of a single channel element of the array with the interposed ridges extending inwardly and abutting the facing edge wall portions of adjacent channel elements. The bearing surface of each sealing member is bonded to the abutted channel element edge walls associated therewith, and has a length as measured parallel to the channel element longitudinal axes of at least 0.2 inch which is substantially greater than the thickness of the sealing member as measured perpendicular to the channel element longitudinal axes at a lower extremity of the grooves in the bearing surface thereof.

In this headering arrangement, clip members 69 are provided having a transversely extending first segment **70*a* leak-tightly abutting the outer end 58*a* of the sealing member 58, a longitudinally extending second segment 70*b* integrally joined to the transversely extending first segment and adhesively bonded to an exterior surface of the sealing member, and a third end segment 71 integrally joined to the longitudinally extending second segment 70*b*. The header tank means in FIG. 7 comprise a header tank member 74 having enclosure end wall 77 and side wall 75, 76 portions and a transversely outwardly extending flange portion 80 at an end of each side wall portion. The header tank member is provided with conduit 81 for first fluid introduction to or discharge from the heat exchanger assembly. When header tank member 74 and clip member 69 are disposed in position as assembled, the third end segment 71 of the clip member is deformed contiguously around the transversely outwardly extending flange portion 80** of the header tank member to secure the header tank member in position.

The heat exchanger assembly of FIG. 7 features a tie bar structural support member 66 which is disposed against the side wall of the outermost channel element 53 in the stacked array, to absorb the outwardly directed pressure force exerted by the stacked array in operation. The tie bar 66 is structurally coupled with angle brace member 61 in the heat exchanger assembly. As shown, angle brace member 61 comprises a longitudinally extending portion 62 and a transversely extending portion 64. Each of the clip members 69 has a transversely extending tab 72 which is positioned on the top surface of the transverse portion 64 of angle brace 61. Tie bar 66 is positioned beneath angle brace member 61, with the flange portion 67 of the tie bar abutting the underside of the transverse portion 64 of the angle brace member. The header tank member 74 is then positioned so that the flange portion 80 thereof is disposed against the transverse tabs 72 of the respective clip members 69. In this fashion, the apertures 79 in the flange portion 80 of the header tank member are brought into register with the apertures 73 in the transverse tabs of the clip members 69, apertures 65 in the transverse portion 64 of angle brace member 61 and apertures 68 in the flange portion 67 of tie bar 66, so that bolt or screw means may be inserted through the aligned apertures so as to secure the assembly together. In this manner, apertures 78 in side wall 76 of the header tank member 74 are brought into alignment with apertures 63 in the longitudinally extending portion 62 of the angle brace member 61, so that screw or bolt means can be passed through the aligned apertures for additional securement of the assembly.

Figure 8:
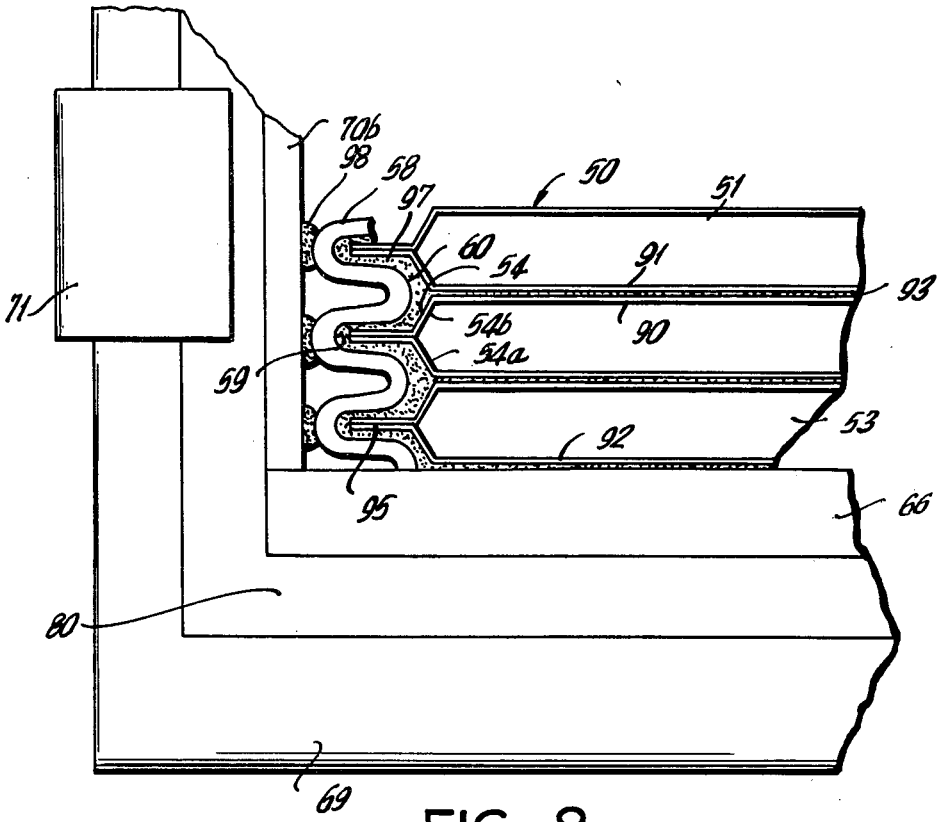
FIG. 8 is a sectional plan view of the heat exchanger assembly of FIG. 7.

FIG. 8 is a sectional plan view of a portion of the FIG. 7 heat exchanger assembly, showing the details of construction thereof. Channel elements 51 in the array 50 are stacked with their end section side walls 90, 91 in wall to wall contacting relationship, adhesively bonded together by adhesive 93 such as epoxy. The channel element end sections each have a cross-section bonded by flat side walls and by edge walls 54 comprising edge wall portions **54*a*, 54*b* extending outwardly from the side walls and convergently with respect to each other, with the outermost ends 95 of the edge wall portions being contiguous and coextensive with respect to one another to form a leak-tight edge wall. In this manner, a first fluid face is formed at an end of the array, having a perimeter defined by edge wall ends of the stacked channel elements and outmost side wall end 92 of the outermost channel element 53 in the array. The serpentine-shaped sealing member 58 extends along the end section edge walls of the channel element at a side of the stacked array. The sealing member 58 has a bearing surface with a generally corrugated contour of grooves 59 and interposed ridges 60 shaped so that the grooves surround and abut the edge wall of a single channel element of the array with the interposed ridges extending inwardly and abutting the facing edge wall portions of adjacent channel elements. The bearing surface of the sealing member 58 is bonded to the abutted channel element edge walls associated therewith by means of adhesive medium 97. The exterior surface of the sealing member 58 is adhesively bonded to the longitudinally extending second segment 70*b* of the clip member 69 by means of adhesive medium 98. The side wall of the outermost channel element 53 in the stacked array is adhesively bonded to tie bar 66. As shown, the third end segment 71 of the clip member 69 is deformed contiguously around the transversely outwardly extending flange portion 80** of the header tank member to secure the header tank member in position.

Figure 9:
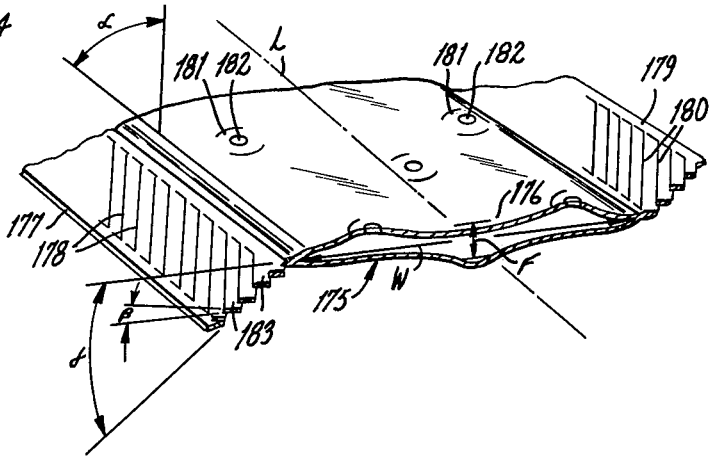
FIG. 9 is an isometric view of a portion of a single heat exchange channel element such as used in the FIG. 7 heat exchanger assembly.

FIG. 9 is an isometric view of a portion of a single heat exchange channel element such as may be advantageously used in the FIG. 7 embodiment of the invention. The channel element 175 is provided with secondary surface heat transfer fins 177 and 179 which are joined to the respective edge walls of the channel element and extend generally outwardly therefrom. The fins are each provided with louver type surface distortions, preferably of the type disclosed and claimed in U.S. Pat. No. 3,845,814, issued Nov. 5, 1974 in the name of L. C. Kun. The channel element features isostress contoured wall surfaces 176 with uniformly disposed outwardly extending wall projections 181, having load-bearing segments 182 at their extremities. Geometric characteristics of the channel element include a longitudinal axis L, with the cross-section of the channel element perpendicular to the longitudinal axis having a major axis maximum width line W and a minor axis F. The minor axis dimension F is not a structurally measurable value, but is rather determined by dividing the measured volume of the channel element by the quantity ($L \times W$), where the values of L and W are directly measured. In accordance with the teachings of the aforementioned U.S. Pat. No. 3,845,814, the widths of the respective secondary surface ends 177 and 179 are between 0.1 and 0.6 inch and each fin has a multiplicity of slotted apertures arranged in a louver configuration. The adjacent slats 183 are separated by slot-shaped apertures having the fin angle $\gamma$ between 0° and 60° where $\gamma$ is the angle formed between the plane of the fin and a plane containing the maximum dimension width line W and the channel's longitudinal axis L. The width of the slats 183 is between 0.82 inch and 0.10 inch and the slat angle $\beta$ is between 15° and 90° where $\beta$ is the angle formed between the plane of the fin and the plane of the slats. Lastly, the slot angle $\alpha$ formed between the longitudinal axis L of the channel and the longitudinal length line of the slots, is between 0° and 180°. Such geometry of secondary surface heat exchange fins is particularly preferred in applications where heat exchanger assemblies according to the present invention are employed as automobile heaters and radiators.

Figure 10:
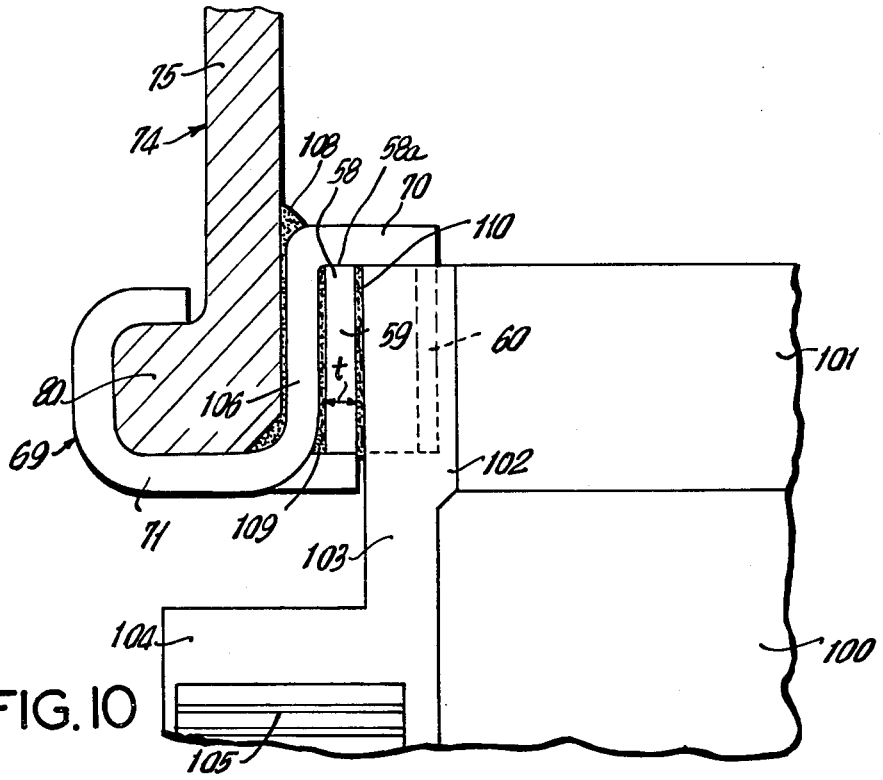
FIG. 10 is a sectional elevational view of a portion of the heat exchanger assembly of FIG. 7.

FIG. 10 is a sectional elevational view of a portion of the heat exchanger assembly of FIG. 7. In the portion of the assembly as shown, the channel element 100 has an end section 101 and edge wall portions 102 having outer ends 103 which form a leak-tight edge wall. The channel element features a secondary surface fin 104 with slatted, louver-type surface distortions 105 thereon. The header tank member 74 has a transversely outwardly extending flange portion 80 at an end of the side wall portion 75. The sealing member 58 has bearing surface with a generally corrugated contour of grooves 59 and interposed ridges 60, with each of the grooves shaped so as to surround and abut the edge wall of a single channel element of the array with the interposed ridges extending inwardly and abutting the facing edge wall portions of adjacent channel elements. The bearing surface of the sealing member 58 is bonded to the abutted channel element edge walls associated therewith by adhesive bonding medium 110. Sealing element 58 has a length as measured parallel to the channel element longitudinal axis of at least 0.2 inch which is substantially greater than the thickness t of the sealing member as measured perpendicular to the channel element longitudinal axis at a lower extremity of the grooves in the bearing surface thereof. The headering arrangement comprises clip member 69 having a transversely extending first segment 70 leak-tightly abutting the outer end **58*a* of the sealing member 58, a longitudinally extending second segment 106 integrally joined to the transversely extending first segment 70 and adhesively bonded to an exterior surface of the sealing member by adhesive bonding medium 109, and a third end segment 71 integrally joined to the longitudinally extending second segment 106 and deformed contiguously around the transversely outwardly extending flange portion 80 of the header tank member 74 to secure the header tank member in position. As shown, the clip member second segment 106 is also adhesively bonded to the header tank member enclosure side wall portion 75 by adhesive 108** to further secure the header tank member in position.

Figure 11:
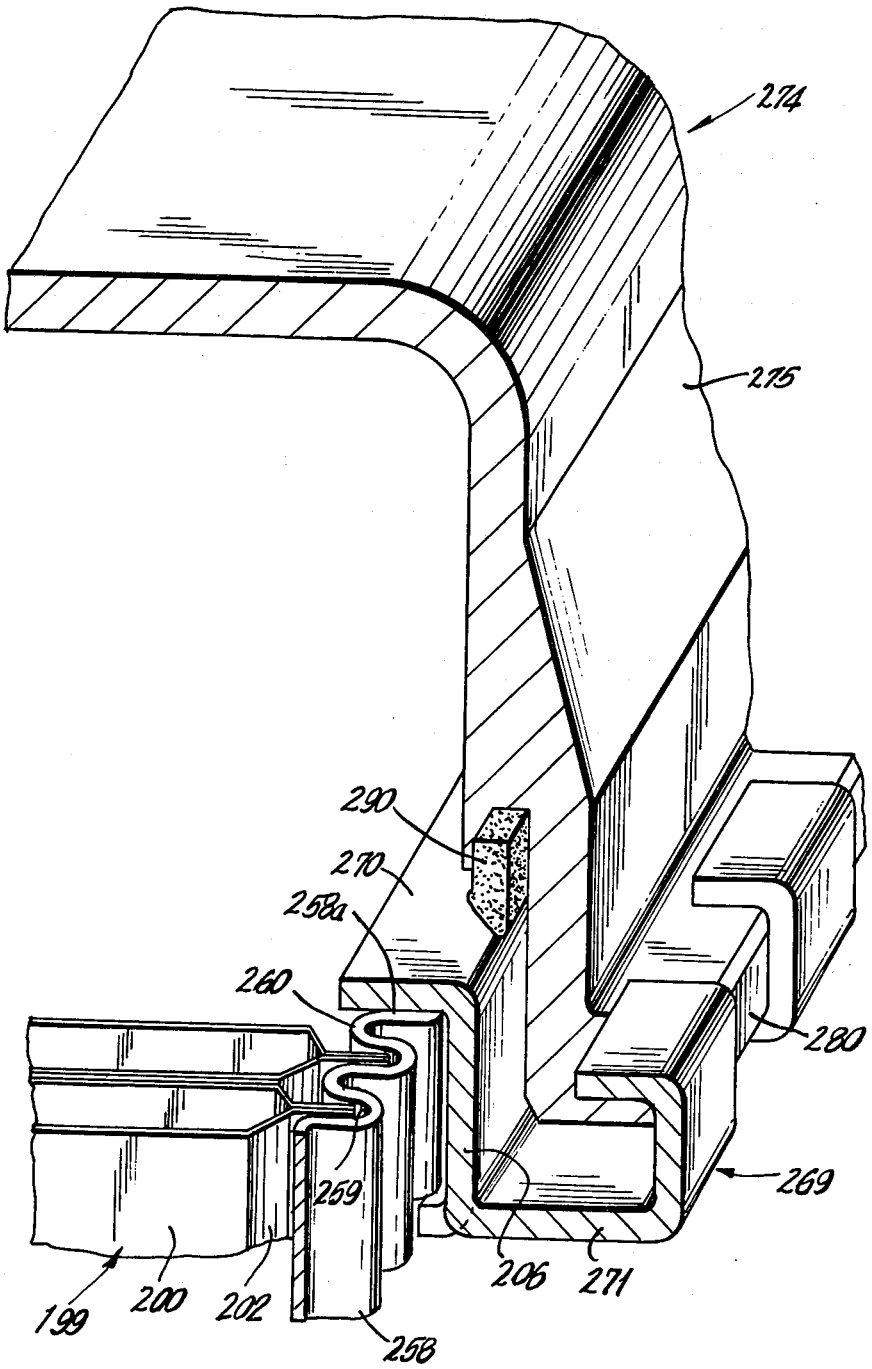
FIG. 11 is an isometric view of a portion of a heat exchanger assembly according to still another embodiment of the invention.

FIG. 11 is an isometric view of a portion of a heat exchanger assembly employing another type of headering arrangement in accordance with the present invention. In the portion of the assembly as shown, the heat exchanger core 199 comprises a stacked array of channel elements 200 each having edge wall portions 202 which form a leak-tight edge wall. The header tank member 274 has a transversely outwardly extending flange portion 280 at an end of the side wall portion 275. The sealing member 258 has a bearing surface with a generally corrugated contour of grooves 259 and interposed ridges 260, with each of the grooves shaped so as to surround and abut the edge wall of a single channel element of the array with the interposed ridges extending inwardly and abutting the facing edge wall portions of adjacent channel elements. The bearing surface of the sealing member 258 is suitably bonded to the abutted channel element edge walls associated therewith by an adhesive bonding medium as described hereinabove in connection with FIG. 10. Sealing element 258 has a length as measured parallel to the channel element longitudinal axis of at least 0.2 inch which is substantially greater than the thickness of the sealing member as measured perpendicular to the channel element longitudinal axis at a lower extremity of the grooves in the bearing surface thereof. The headering arrangement comprises clip member 269 having a transversely extending first segment 270 leak-tightly abutting the outer end **258*a* of the sealing member 258, a longitudinally extending second segment 206 integrally joined to the transversely extending first segment 270 which may be adhesively bonded to an exterior surface of the sealing member 258 by any suitable adhesive bonding medium, and a third end segment 271 integrally joined to the longitudinally extending second segment 206 and deformed contiguously around the transversely outwardly extending flange portion 280 of the header tank member 274 to secure the header tank member in position. As shown, a gasket 290 is positioned in a groove in the side wall 275 of the header tank member 274 such that the gasket bears compressively against the upper surface of the clip member first segment 270 to form a leak-tight seal between the heat exchanger core assembly and the header tank member 274**. In practice, the gasket may be formed of any suitable material as for example Buna-N or neoprene having a durometer value of 60 to 80.

What is claimed is:

1. In a heat exchanger assembly including: a stacked array of heat exchange channel elements, wherein each channel element is bounded by thermally conductive pressure withholding walls, with a first fluid entrance opening at one end, a first fluid exit opening at the opposite end, and end sections each having a cross-section bounded by flat side walls and by edge walls comprising edge wall portions extending outwardly from said side walls and convergently with respect to each other, with the outermost ends of the edge wall portions being contiguous and coextensive with respect to one another to form a leak-tight edge wall and wherein adjacent channel elements in said array are stacked with their end section side walls in wall to wall contacting relationship and their end section edge walls in alignment to form a first entrance face at one end of said array and a first fluid exit face at the opposite end of said array, each said face having a perimeter defined by edge wall ends of the stacked channel elements and outermost side wall ends of the outermost channel elements in said array, and with said pressure withholding walls of adjacent channel elements in the interior of said array being disposed in spaced relationship with respect to each other for flow of a second fluid through said array in the space between said channel elements in heat exchange with said first fluid; an inlet header joined in flow communication with said first fluid entrance face for introduction of first fluid to said channel elements, and an outlet header joined in flow communication with said first fluid exit face for withdrawal of first fluid from said channel elements, each said header comprising the improvement of: sealing members extending along the end section edge walls of the channel elements at each side of the stacked array, each having a bearing surface with a generally corrugated contour of grooves and interposed ridges, with each of said grooves shaped so as to surround and abut the edge wall of a single channel element of said array with the interposed ridges extending inwardly and abutting the facing edge wall portions of adjacent channel elements, wherein the bearing surface of each sealing member is bonded to the abutted channel element edge walls associated therewith and has a length as measured parallel to the channel element longitudinal axes of at least 0.2 inch which is substantially greater than the thickness of said sealing member as measured perpendicular to the channel element longitudinal axes at a lower extremity of the grooves in said bearing surface thereof; and header tank means joined to said sealing members so as to leak-tightly enclose the associated face of the stacked array of heat exchange channel elements.

2. A heat exchanger assembly according to claim 1 wherein said sealing members each comprise a longitudinally extending flange portion to which said header tank means are joined.

3. A heat exchanger assembly according to claim 1 wherein the bearing surface of each sealing member is adhesively bonded to the abutted channel element edge walls associated therewith.

4. A heat exchanger assembly according to claim 3 wherein the adhesive bond between said bearing surface of each sealing member and said abutted channel element edge walls associated therewith is less than 0.02 inch in thickness.

5. A heat exchanger assembly according to claim 1 wherein said sealing member is of uniform thickness.

6. A heat exchanger assembly according to claim 5 wherein said thickness of said sealing member is less than 0.1 inch.

7. A heat exchanger assembly according to claim 1 constructed and arranged for flow of said second fluid through said array in a direction normal to the longitudinal axis of said channel elements.

8. A heat exchanger assembly according to claim 1 wherein said thermally conductive pressure withholding walls are formed of aluminum.

9. A heat exchanger assembly according to claim 1 wherein said thermally conductive pressure withholding walls are of between 0.003 and 0.020 inch thickness.

10. A heat exchanger assembly according to claim 1 wherein said pressure withholding walls of each of said channel element in the interior of said array have a multiplicity of uniformly disposed outwardly extending projections formed from a portion of the wall surface, said projections having load-bearing segments at their extremities whereby the facing walls of said adjacent channel elements are mated in supportive relationship with each other.

11. A heat exchanger assembly according to claim 1 wherein the channel element end section flat side walls disposed in wall to wall contacting relationship are adhesively bonded to each other.

12. A heat exchanger assembly according to claim 1 wherein the length of said bearing surface is at least twice the thickness of said sealing member.

13. A heat exchanger assembly according to claim 1 wherein said header tank means comprise: a header tank member having enclosure end wall and side wall portions and a transversely outwardly extending flange portion at an end of each side wall portion; and a clip member having: (1) a transversely extending first segment leak-tightly abutting the outer end of said sealing member, (2) a longitudinally extending second segment integrally joined to said transversely extending first segment and adhesively bonded to an exterior surface of said sealing member, and (3) a third end segment integrally joined to said longitudinally extending second segment and deformed contiguously around said transversely outwardly extending flange portion of said header tank member to secure said header tank member in position.

14. A heat exchanger assembly according to claim 13 wherein said clip member second segment is also adhesively bonded to a header tank member enclosure side wall portion to secure said header tank member in position.

* * * * *